United States Patent [19]

Slanhoff

[11] 4,167,933

[45] Sep. 18, 1979

[54] ENGINE SYSTEM

[76] Inventor: Bertram Slanhoff, 1243 Post Rd., Scarsdale, N.Y. 10583

[21] Appl. No.: 893,796

[22] Filed: Apr. 5, 1978

Related U.S. Application Data

[63] Continuation of Ser. No. 721,292, Sep. 8, 1976, abandoned.

[51] Int. Cl.[2] ..... F02B 53/04

[52] U.S. Cl. ..... 123/222; 123/233; 418/226; 418/227

[58] Field of Search ..... 123/222, 228, 233; 418/195, 198, 226, 227

[56] References Cited

U.S. PATENT DOCUMENTS

| | | | |
|---|---|---|---|
| 610,191 | 9/1898 | Milligan | 418/198 |
| 937,298 | 10/1909 | Finch | 418/198 X |
| 1,131,922 | 3/1915 | Foss | 418/195 |
| 1,286,900 | 12/1918 | Ashcraft | 123/222 |

FOREIGN PATENT DOCUMENTS

| | | | |
|---|---|---|---|
| 55075 | 8/1943 | Netherlands | 418/198 |
| 874045 | 8/1961 | United Kingdom | 418/226 |

*Primary Examiner*—Carlton R. Croyle
*Assistant Examiner*—Leonard E. Smith
*Attorney, Agent, or Firm*—Paul J. Sutton

[57] ABSTRACT

The present invention teaches a novel internal combustion engine wherein a unique structural means of transmitting combustion-generated forces and motion is incorporated. A journalled rotor assembly having combustion cavities in each of opposing faces thereof receives a combustible fluid. A main cam carried by an output shaft which is integral with the rotor assembly drives intermittent-motion cams carried on transfer shafts. Transfer plates integral with the transfer shafts and captively movable within housings rotate into and out of the combustion cavities so as to define the variable working volumes of each cavity. With each of the firings, the rotor is caused to spin in a direction opposite with respect to the relative rotational direction of the respective transfer plates.

7 Claims, 16 Drawing Figures

ENGINE SYSTEM

This is a continuation of application Ser. No. 721,292, filed Sept. 8, 1976, now abandoned.

The present invention relates generally to engines, and more particularly to internal combustion engines of the four-cycle, rotary type.

Recent fuel conservation and ecological trends have focused the attention of designers and the general public upon the conventional internal combustion (IC) engine. Some have criticized engine manufacturers for treating emission problems symptomatically, while calling for basic refinery changes in the fuels consumed. Others have sought to modify IC engines so as to provide users with more efficient devices. Still others chase rather unorthodox approaches to driving our power equipment, utilizing everything from hydrogen fuels to the more conventional fluids.

The rotary-type engine has gained notoriety in recent years, especially with the appearance of the Wankel engine on the scene. With its inherent sealing problems minimized, the Wankel was immediately heralded when its relatively low combustion temperatures were analyzed. Those familiar with auto emission problems recognized that the nitrogen oxides produced at higher combustion temperatures in reciprocating engines were greatly minimized in rotary engines, without any adverse affect upon hydrocarbon and carbon monoxide levels. The reduced number of moving parts likewise made rotary engines the hope of the future. And yet, apart from the automotive field, a need exists for an efficient and relatively simply constructed engine that may be used in a number of applications.

A search of the prior patent art has uncovered a number of rather complicated and, in some cases, impractical approaches to rotary engine design. The following brief summary will indicate efforts that go back more than half a century.

U.S. Pat. No. 1,219,829 to Marion was granted in March of 1917 and covers a rotary engine wherein a spring-loaded oscillating abutment block cooperates with and underlies a rotary-type piston. This sincere but rather primitive attempt to teach a governor-controlled rotary engine is of interest in that primary and secondary elements which are pivotally supported are shown to cooperate with one another in a cam-like action. This patent is of interest and is mentioned because of the cam action provided and taught by the present invention, as set forth in detail below.

U.S. Pat. No. 1,228,806 to Morris was granted in the same year and discloses a rotary internal combustion engine wherein a rotor carries sliding pistons which draw in an explosive mixture, compress it and, on explosion of the charge, rotates and draws in the new charge so as to continue the cycle. U.S. Pat. No. 1,272,728 to Tower granted the following year is of interest in that a rotary engine is disclosed therein wherein gearing is illustrated in FIG. 2.

U.S. Pat. No. 1,319,932 to Stevenson, granted on Oct. 28, 1919, is mentioned because of the disclosure of a cam 22 which causes a cylindrical piston 19 to oscillate. This oscillation is interesting, though non-anticipatory of the intermittent-type cam behavior taught by the present invention and described in detail below.

U.S. Pat. No. 2,263,274 to Piper discloses a rotary diesel internal combustion engine which includes a chamber of an irregular but predetermined contour, thereby causing a reciprocatory movement of elements within the central rotating piston shown in FIG. 1 thereof. Another rotary internal combustion engine is disclosed in U.S. Pat. No. 2,373,304 to Garbeth, wherein FIG. 1 best illustrates the cooperative aspects of two rotating members within their respective chambers.

U.S. Pat. No. 2,938,505 to Quartier discloses a rotary central element having cam-like surfaces which transmit oscillating movement to four spaced elements arranged around the periphery thereof. These annularly spaced elements are spring-biased toward the central rotating member by means of springs 106, which return the elements to their inwardmost positions.

U.S. Pat. No. 3,791,352 to Takacs discloses a rotary engine wherein cooperating cam-like surfaces which are interengaged with one another control the rotation of each relative to the other.

U.S. Pat. No. 3,820,513 to Buettner represents another example of a rotary engine structure which seeks to provide favorable performance characteristics.

Examples of foreign patent art which teach various structures incorporating rotary-type engines include German Pat. No. 287,689, wherein a rotor K rotates intermittently as a result of the engagement of vanes f with cooperating vanes o. Others include German Publication No. 1,451,839, French Pat. No. 443,334, and French Pat. Nos. 493,491 and 1,211,335. Canadian Pat. No. 646,622 is cited as a matter of interest.

It is an object of the present invention to provide a rotary internal combustion engine of a novel design and structure.

Another object of the present invention is to provide a relatively inexpensive internal combustion engine having a structural makeup for transferring and converting combustion energy into a relatively smooth rotary movement or motion, without undesirable vibration normally inherent in reciprocating-type internal combustion engines.

A further object of this invention is to provide a novel means of transferring or conveying continuous rotary movement into a predetermined and controlled intermittent movement associated with a transfer plate.

Still another object of the present invention is to provide a novel means of controlling and varying the shape and working volume of combustion chambers located within a rotor assembly, whereby a plurality of transfer plates which turn in a controlled intermittent movement define movable walls of these chambers.

A yet further object is to provide novel means of controlling and conveying the combustible fluid charge of a rotary internal combustion engine.

Still yet another object of the present invention is to provide novel cam means for transferring continuous rotary movement about one axis to a locked intermittent rotary movement about a second axis which is substantially perpendicular to the first axis.

A further object is to provide a novel transfer plate assembly which turns in a direction opposite to the direction of surfaces of a rotor assembly with which the transfer plate assembly is associated.

Another object is to provide an internal combustion engine of the rotary type wherein the combustible charge is transferred by means of transfer plates among a plurality of cavities or combustion chambers.

The present invention fulfills the aforementioned objects and overcomes the limitations and disadvantages of prior art attempts to solve the vibration and other problems associated with the prior art by providing, in one embodiment of this invention, a rotary internal combustion engine haing an overall housing within which a rotating rotor assembly is journalled. The rotor assembly is formed with a plurality of elongated cavities having axes which lie along circular paths concentrically about the axis of an output shaft which is integral with the rotor assembly. A main or primary cam is carried on each side of the dividing plane of the rotor assembly by the output shaft, each of these two main cams driving in an intermittent-type motion two intermittent cams which are locked in placed when not being driven. Shafts which carry the intermittent cams also carry and are integral with transfer plates of substantially cylindrical but disc-like shape which rotate and move into and out of combustion cavities or chambers located within the rotary assembly. These discs serve to define the variable volume of the combustion cavities or chambers, while also serving to transfer a combustible charge located within each cavity to another of the cavities, thereby effecting the overall combustion process.

The novel method of generating power utilizing the rotary internal combustion engine just described includes conducting combustible fluid in a charge into a first compression cavity within the rotor assembly by means of a negative pressure differential caused by an expanding volume of the compression cavity by relative movement as between the walls of the cavity and a transfer plate extending at substantially right angles into this cavity. Compression of this charge of combustible fluid occurs as a result of this same relative movement, but between the walls of the compression cavity and a second transfer plate that has been rotated into a right angle position within the cavity. The compressed charge is actually removed from the compression chamber by means of the second transfer plate into a transfer chamber while the rotor assembly continues its continuous rotary movement and until a combustion chamber communicates with and overlies the second transfer plate, whereupon the second plate is further rotated after resting in a locked position into the combustion chamber and the charge is ignited. The forces of combustion of the charge are exerted against the second transfer plate and the walls of the combustion cavity such that the working volume of the combustion cavity is forced to increase, thereby driving the rotor assembly. The exhaust gases generated by the combustion of the charge are evacuated as a result of a positive pressure differential caused by the relative rotary movement of the rotor assembly and the first transfer plate, while simultaneously a second charge is introduced into the compression chamber on the opposite side of this same first transfer plate.

My invention will be more clearly understood from the following description of specific embodiments of the invention, together with the accompanying drawings, wherein similar reference characters denote similar elements throughout the several views, and in which:

FIG. 1 is an exploded schematic perspective view of a portion of an engine according to the present invention;

FIGS. 2*a* through 2*i* are partial fragmentary sectional schematic illustrations depicting the combustion cycle of the engine system according to the present invention, with particular emphasis upon the relationship between transfer plates and the rotor housing;

Figure 1:
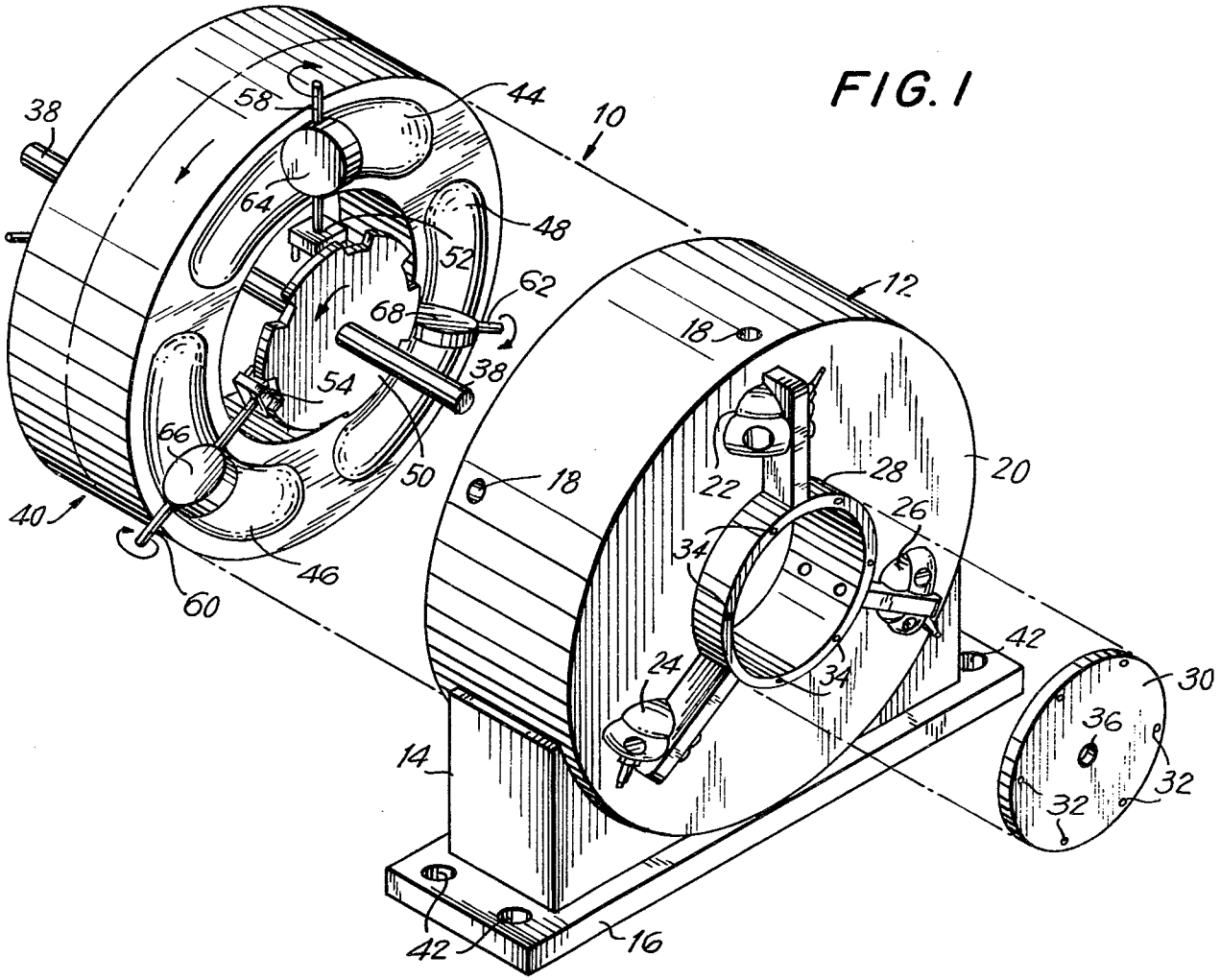

Referring now in more detail to the drawings, the reader's attention is directed to FIG. 1 which in a schematic exploded perspective illustration attempts to disclose a concept in one form of the present invention. It is to be emphasized here that the specific structure in FIG. 1 may represent a commercial embodiment of the present invention, and is merely presented to give the reader an idea of the nature of my invention.

An engine system 10 is shown to include a housing 12 supported by a saddle 14 which, in turn, rests upon a base plate 16. Housing 12 is formed with a plurality of openings 18 designed to accommodate protruding transfer shafts that will be described in more detail below.

A forward face 20 of housing 12 carries three transfer housings 22, 24 and 26 which are equally spaced about face 20, and which surround a central cylindrical hub 28 to which a cover plate 30 is normally removably secured, such as by conventional fasteners which extend through openings 32 and 34 in the cover plate and hub, respectively. Cover plate 30 includes a central opening 36 through which an output shaft 38 associated with a rotor assembly 40 extends.

In use, rotor assembly 40 is housed within housing 12 for continuous rotary movement therewithin. The entire system 10, as depicted in this representational but unrealistic illustration in FIG. 1, may be secured to a mounting surface by means of mounting holes 42 formed in base plate 16.

Rotor assembly 40, in the embodiment shown in FIG. 1, includes three cavities in each face thereof. Cavities 44, 46 and 48 are shown in FIG. 1. These cavities extend along a common radius and are of equal lengths and spacing from one another.

A main cam 50 is shown carried by and keyed to output shaft 38 which, in turn, is integral with rotor assembly 40. In the case of the illustration of the invention depicted in FIG. 1, there is a main cam associated with each base of rotor assembly 40. Cam 50 is formed with notched cam surfaces which provide means for transmitting forces and movement. Intermittent cam assemblies 52, 54, and 56 (not shown) are integral with and carried by transfer shafts 58, 60 and 62, respectively. Transfer plates 64, 66 and 68 are keyed to and carried by transfer shafts 58, 60 and 62, respectively.

Transfer plates 64, 66 and 68 rotate in an intermittent-type movement resulting from the cooperative engagement between cam 50 and intermittent cams 52, 54 and 56. These transfer plates and portions thereof, rotate into and out of cavities 44, 46 and 48 in directions opposite with respect to the direction of rotation of rotor assembly 40. This intermittent rotary movement of the transfer plates occurs within transfer housings 22, 24 and 26 in a manner which provides energy via internal combustion of combustible fluids within cavities 44, 46 and 48, as will be described in more detail below with respect to a more representative commercial embodiment of this invention.

My purpose in presenting FIG. 1, even though it is but a schematic and incomplete illustration of a concept representative of the present invention is to illustrate the relative movement and relationship between the transfer plates 64, 66 and 68 and the rotor assembly 40 with its cavities 44, 46 and 48. The present invention contemplates utilizing transfer plates which serve a number of different functions. More specifically, the transfer plates defined by and disclosed by this invention serve as intermittently movable chamber walls which help to define the working volume of compression and combustion cavities or chambers within rotor assemblies disclosed hereunder. In addition, these transfer plates assist in actually removing compressed combustible charges of fluid entirely from compression chambers or cavities into transfer cavities whereupon, thereafter, the charge is ignited with the result that forces exerted by the exploding charge against a face of predetermined transfer plates assists in the driving force necessary to rotate rotor assembly 40 in a continuous rotary movement about the axis of output shaft 38, for example.

Again, as I have done in the case of presenting FIG. 1, I present FIGS. 2*a* through 2*i*, inclusive, which in a schematic illustrative form will assist the reader in understanding the concept associated with the transfer plates provided by the present invention. This is done prior to referring to more specific working structure in FIGS. 3–8 so that the reader will appreciate from a reading of the specification below the function and benefits afforded by the intermittently moving transfer plates influenced by their associated intermittent cam assemblies and the cooperative main cams.

In FIGS. 2*a* through 2*i*, in each case reference character 70 has been used to depict the outer wall of a rotor assembly. It is to be kept in mind that rotor assembly 70 and its walls actually move in a circular path. However, FIGS. 2*a* through 2*i* disclose an arrangement as if the radius of this rotor were infinite, in order to give the reader an easy impression of the cooperative interaction of the parts. The direction of rotation or movement of rotor 70 with respect to the transfer plates is shown by an arrow in the case of each of FIGS. 2*a* through 2*i* to the left thereof.

For purposes of describing FIGS. 2*a* through 2*i*, three transfer plates 72, 74 and 76 are shown. It should be emphasized here that the number of transfer plates and the number of cavities associated with the rotary engine disclosed by this invention may be varied without departing from the scope of the invention. For example, FIG. 1 illustrates a rotor assembly with three cavities in each face. It is contemplated that two cavities in each face of the rotor assembly or other alternative arrangements shall come within the scope of the present invention. FIGS. 3 through 8 contemplate a total of four cavities, two within each face of the rotor assembly, as will be become apparent from the specification set forth herein-below.

Figure 2A:
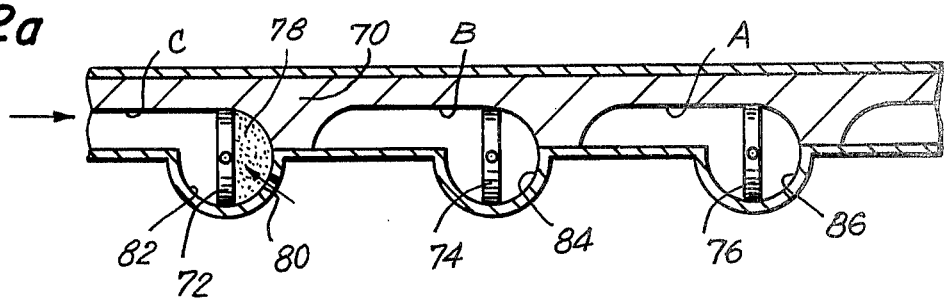

FIGS. 2*a* through 2*i* basically represent and illustrate a sequence of events which will occur during the operation of this invention. Cavities A, B, and C are shown in FIG. 2*a*, for example, and represent either combustion or compression chambers formed within rotor 70. In FIG. 2*a*, a charge 78 or quantity of combustible fluid is shown being introduced through a port 80 formed in a wall defining a transfer cavity 82. Likewise, as in the case of transfer cavity 82 being associated with transfer plate 72, transfer cavities 84 and 86 are associated with transfer plates 74 and 76, respectively.

Figure 2B:
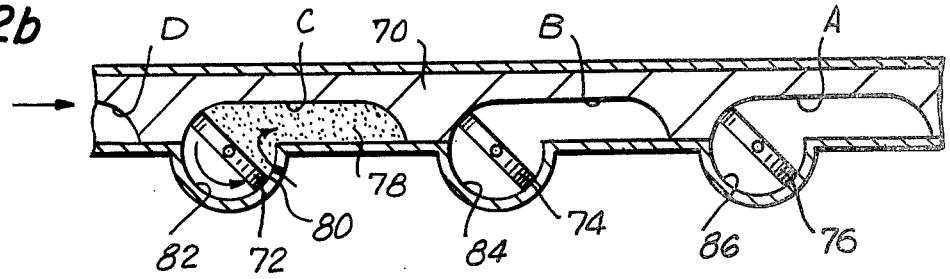

The surfaces of the transfer plates which come into contact with either the walls of cavities within rotor 70 or the walls of the transfer cavities are sealed by means of conventional sealing means such that a fluid-tight seal exists as between all such surfaces. Accordingly, as rotor assembly 70 moves to the right, as shown in FIG. 2*b*, the increase in volume between the walls defining cavity C and the face of transfer plate 62 creates a negative pressure or vacuum, thereby causing a suction of combustible fluid or charge 78 into cavity C.

Figure 2C:
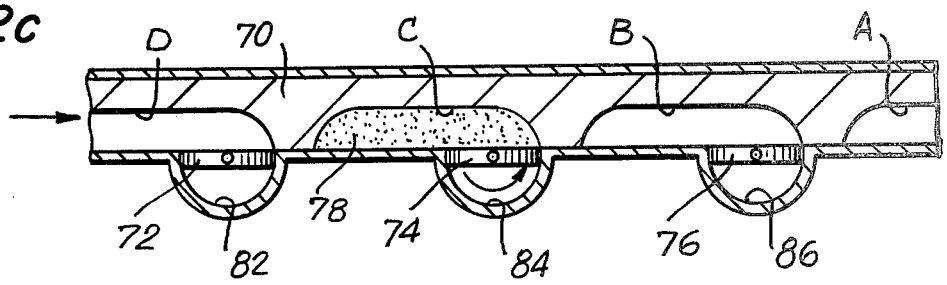

As charge 78 has entered cavity C and substantially fills the cavity, transfer plate 72, together with all other transfer plates 74 and 76 in unison, rotates in a direction opposite with respect to the direction of movement of rotor 70 until the transfer plates assume the positions shown in FIG. 2*c*. In the positions shown in FIG. 2*c*, the transfer plates and portions thereof have removed themselves entirely from the cavities, thereby permitting the continuous rotary movement of rotor assembly 70 in the direction shown in these drawings.

Figure 2D:
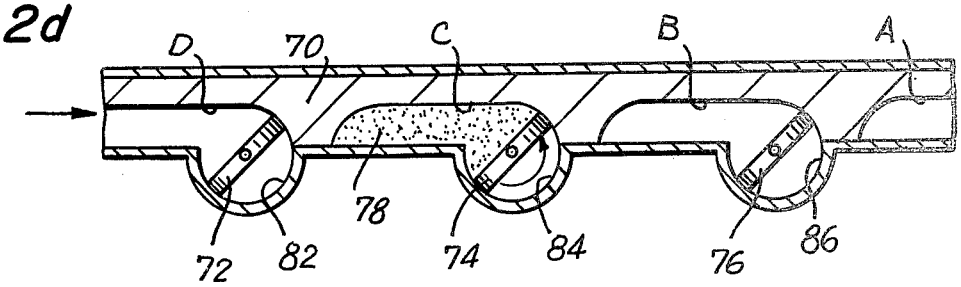
Figure 2E:
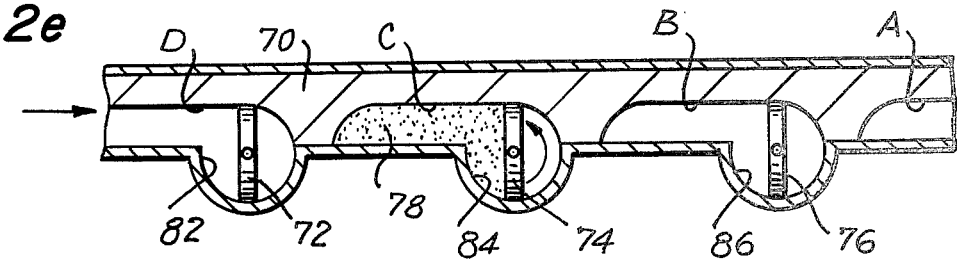

Compression of combustible fluid charge 78 within chamber or cavity C is shown to begin in FIG. 2*d*, wherein transfer plate 74 begins to rotate counterclockwise in a direction opposite that of the movement of rotor assembly 70 until it assumes the position shown in FIG. 2*e* where, upon further movement of rotor assembly 70, charge 78 is compressed against the leftmost face of transfer plate 74. The transfer plate 74 remains in this position shown in FIG. 2*e* while rotor assembly 70 moves to the right and, thereafter, upon further counterclockwise movement to the position shown in FIG. 2*f*, the entire compressed charge 78 is actually transferred from chamber or cavity C into transfer cavity 84. With the transfer plates 72, 74 and 76 in these Figures remaining in the position shown in FIG. 2*f*, rotor assembly 70 continues to move such that chamber or cavity C progresses toward transfer plate 76.

Figure 2F:
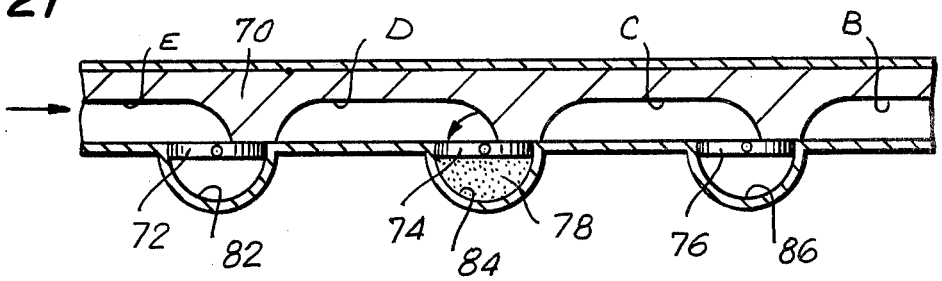
Figure 2G:
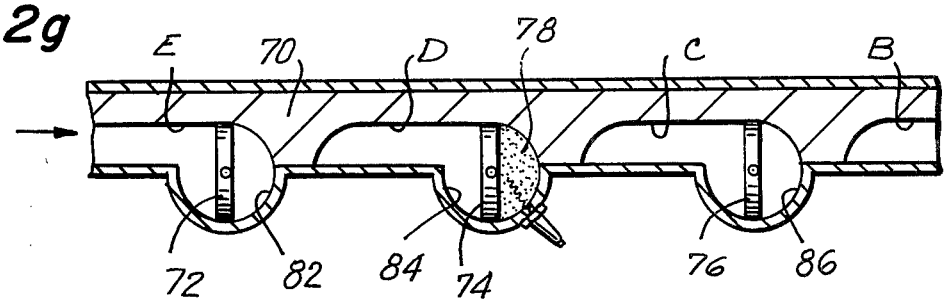
Figure 2H:
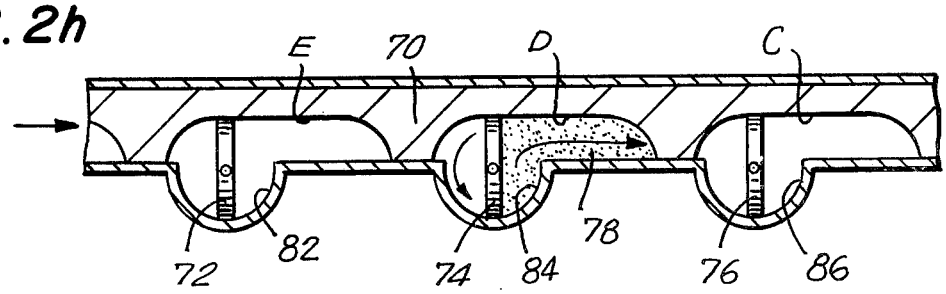

Once chamber or cavity D overlies transfer plate 74, this transfer plate rotates counterclockwise as in the position shown in FIG. 2*g*, whereupon the charge 78 is ignited by means of a sparkplug 88, with the result that the forces generated by the combustion of charge 78 push or force rotor assembly 70 along in its direction of movement, best seen in FIG. 2*h*.

After the combustion and forced movement just described, transfer plate 74 rotates into the position previously described for FIG. 2*f* such that cavity D within which this combustion process has taken place is able to move to positions overlying transfer plate 76. Transfer plate 76 rotates counterclockwise to the position shown in FIG. 2*i*, with the result that further movement of the walls defining chamber or cavity D cause evacuation of the exhaust gases generated by combustion of charge 78 through an outlet port 90 in transfer cavity 86. It should be noted here that while the exhaust gases resulting from the combustion of charge 78 are being exhausted or evacuated through outlet port 90, a new charge 92 is being introduced through an inlet port 94 formed in transfer cavity 86 in the same manner previously described for charge 78 in FIG. 2*a*.

In fact, it is contemplated by the present invention that transfer plate 76 actually be and correspond to transfer plate 72, and that cavities A and C be one and the same cavity in an embodiment of the present invention wherein two cavities exist along each face of the rotor assembly. In such a case, to be described in more detail below for FIGS. 3-8, cavity B is one and the same cavity as cavity D, these cavities B and D being compression cavities, while cavities A and C can best be described as combustion cavities. I have used successive letters of the alphabet E and F which, of course, actually will correspond to the chambers or cavities C and D used to describe the process above.

It should also be noted that throughout FIGS. *2a–2i*, the transfer plates have been shown to move in counterclockwise directions as depicted in these Figures in an intermittent-type rotary movement between the positions shown in FIGS. *2a, 2e, 2g, 2h* and *2i*, on the one hand, and the positions shown in FIGS. *2c* and *2f*.

Figure 3:
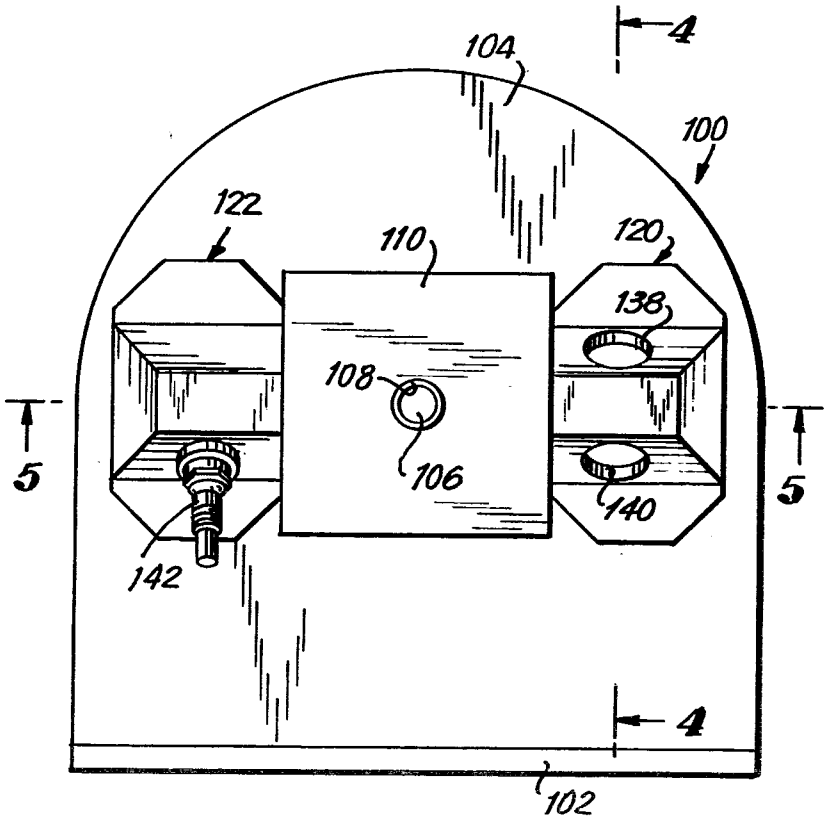
FIG. 3 is an elevational view of one side of the engine system comprising my invention.
Figure 4:
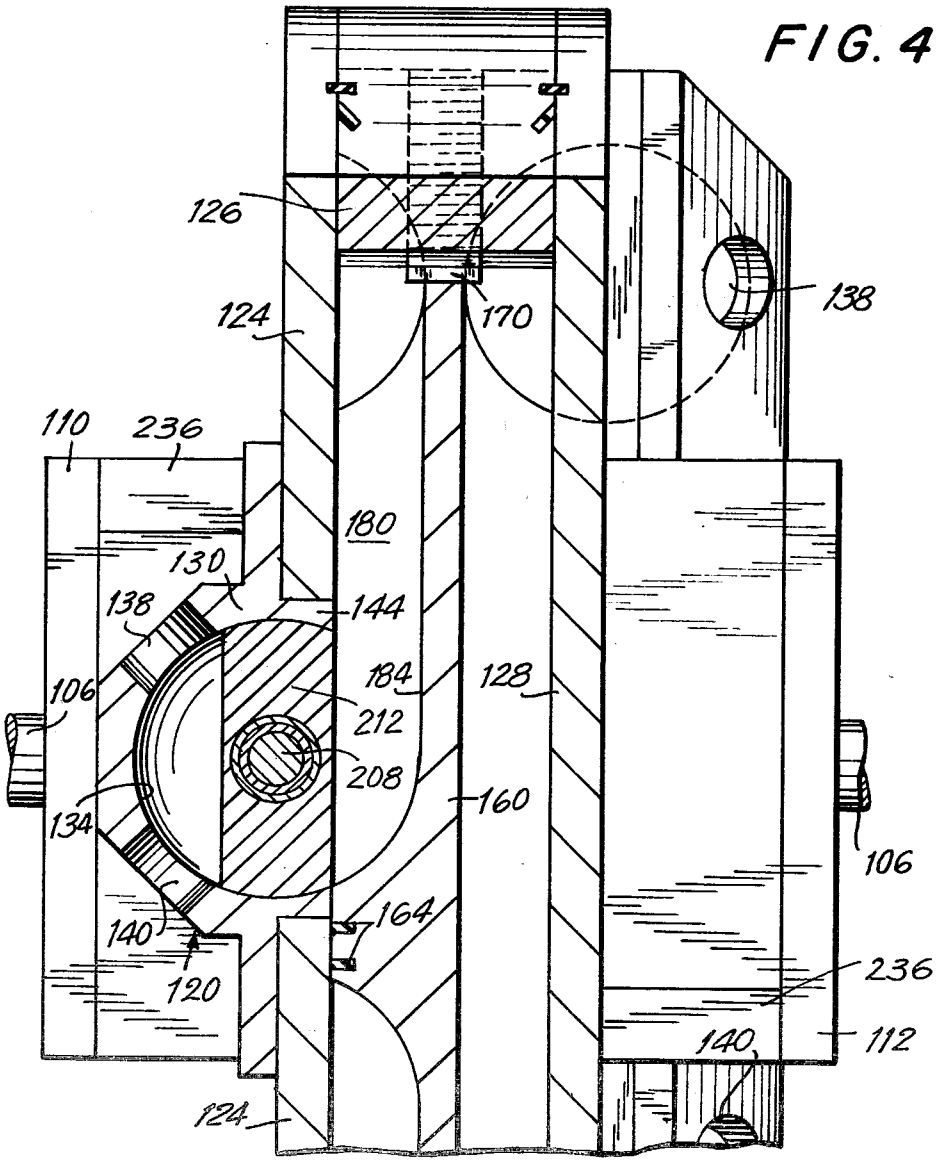
FIG. 4 is a partial fragmentary sectional plan view taken along line 4—4 of FIG. 3.

Referring now to FIG. 3, a rotary engine system 100 is shown and will be described in order to more realistically depict a typical structure according to the present invention. A base support plate 102 supports an engine housing 104 wherein an internal combustion system generates power that is transmitted to an output shaft 106 which extends through an opening 108 in a cover plate 110 secured to the outside surfaces of housing 104. A like cover plate 112 with its central opening 114 can best be seen in FIG. 5, wherein it is also shown that a bearing assembly 116 is housed within opening 108, and a bearing assembly 118 is housed within opening 114 such that output shaft 106 is journalled therein and therebetween.

Figure 5:
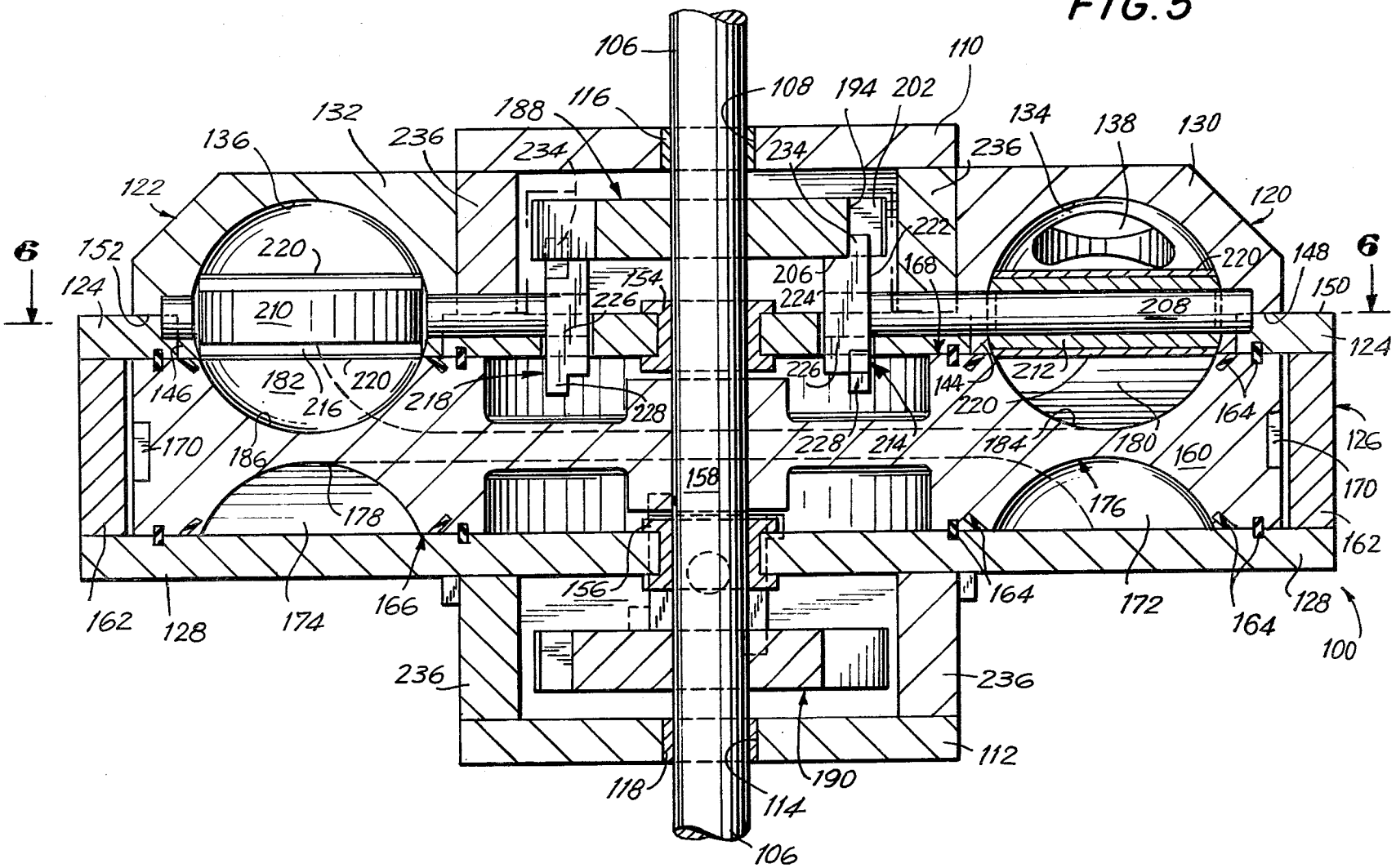
FIG. 5 is a fragmentary sectional elevational view taken along line 5—5 of FIG. 3.

FIG. 3 further illustrates two transfer housings 120 and 122 secured to and within a face plate 124 comprising one side or housing of a moveable and rotating rotor assembly 126. An opposing face plate 128 likewise supports a pair of transfer housings that are oriented along an axis either perpendicular to or aligned with the axis of orientation of transfer housings 120 and 122. For purposes of this specification, I will concentrate upon a description of the leftmost side of engine assembly 100 as shown in FIG. 5. The general outline and shape of transfer housings 120 and 122 (as well as the opposing others) are substantially similar in that they consist of metallic walls 130 and 132, respectively, which define transfer cavities 134 and 136 therein. In FIG. 5, reference characters 134 and 136 have been used to describe both these transfer cavities as well as the surfaces of walls 130 and 132 which define them. FIG. 3 illustrates an inlet port 138 and an outlet port 140 defined and formed within the wall 130 of transfer housing 120. Inlet port 138 communicates by means of ducting with a carburetor, while outlet port 140 communicates with an exhaust manifold. In the case of transfer housing 122, an opening therein accommodates a sparkplug 142 whose specific structure does not come within the scope of this invention.

As best seen in FIG. 5, each of transfer housings 120 and 122 are formed with a protruding cylindrical wall, designated with reference characters 144 and 146, respectively. In the case of cylindrical wall 144, this wall extends from an annular bearing surface 148 which engages outside surfaces 150 of face plate 124. The outer surfaces 150 of face plate 124 are likewise engaged by an annular bearing surface 152 immediately surrounding cylindrical protruding wall 146. It is along this interface between bearing surfaces 148 and 152, and the surfaces 150 that each engage that line 6—6 is taken to depict FIG. 6, and this plane shall hereafter sometimes be referred to as a "transfer plane".

Bearings 154 and 156 are shown in FIG. 5 located or disposed within substantially central openings formed in face plates 124 and 128, respectively, these bearings serving to journal shaft 106 internally of bearings 116 and 118. Shaft 106 at a central portion 158 thereof is integrally secured to a central rotor member 160 comprising a portion of rotor assembly 126.

Rotor member 160 preferably consists of a single or halved metallic member either precision cast or machined in a configuration that will be described in more detail below. Rotor member 160 is located between face plates 124 and 128, as well as an outer cylindrical spacer member 162, best seen in FIG. 5. Together with shaft 106, rotor member 160 is able to rotate about the axis of shaft 106 and includes a number of recesses to accommodate a plurality of sealing members 164 along its opposing faces 166 and 168.

An annular starting gear 170 is located within and fixed within a groove along the outer periphery of rotor member 160. Starting gear 170, under the influence of a suitable driving and cooperative gear or pinion, enables the starting rotational movement of rotor member 160 when in use. This invention contemplates the use of an electrical starting device for cooperative use with starting gear 170 for these purposes.

A pair of cavities 172 and 174 are formed in face 166 of rotor member 160. Concave substantially cylindrical surfaces 176 and 178 define cavities 172 and 174, respectively.

Likewise, a pair of cavities 180 and 182 are defined by concave spherical surfaces 184 and 186 formed in face 168 of rotor member 160, faces 166 and 168 being located on opposite sides of rotor member 160.

Figure 6:
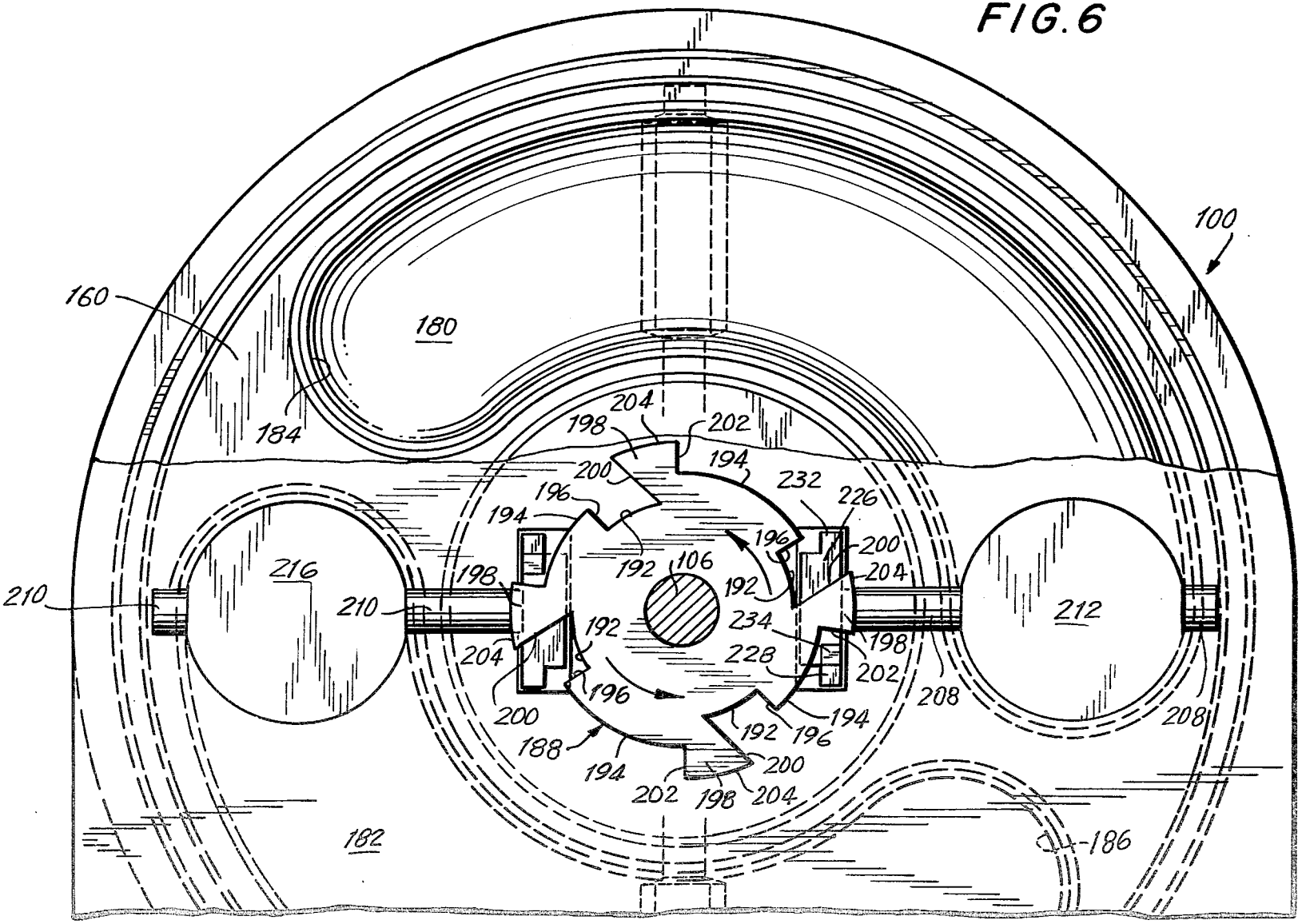
FIG. 6 is a partial fragmentary sectional elevational view taken along line 6—6 of FIG. 5.

FIG. 6 best illustrates the fact that cavities 172, 174, 180 and 182 preferably lie with their axes along a common radius or distance from the axis of rotation of shaft 106. As already suggested above, the centers of cavities 172 and 174 lie at points which are 90° apart from the centers of cavities 180 and 182.

Referring once again to FIG. 5, we see that shaft 106 integrally supports and is keyed to opposing cam members which, for puproses of this specification will be referred to as main cams 188 and 190. Main cams 188 and 190 extend substantially perpendicularly with respect to the axis of shaft 106 and are of a shape and structural configuration that may best be seen in FIG. 6.

Main cams 188 and 190 are preferably substantially identical but for a triangular attack surface which makes one a "lefthand" and the other a "righthand" cam. Looking at FIG. 6, main cam 188 is seen to consist of substantially cylindrical surfaces 192 which extend from shaft 106 at a lesser radius, substantially cylindrical surfaces 194 which are joined with surfaces 192 by substantially radial walls 196, and four outwardly extending finger portions 198 defined by bearing surfaces 200, trailing surfaces 202 and substantially cylindrical outer surfaces 204 which join surfaces 200 and 202.

As best seen in FIG. 5, cam 188 includes a substantially planar bearing surface 206 which actually comprises a portion of the inner face of main cam 188.

Remembering that the present description in this specification for portions of engine system 100 on one side of rotor member 160 are actually duplicated 90° out of phase on the opposite side of rotor member 160, attention of the reader is now directed to a pair of upper and lower transfer shafts 208 and 210, respectively. The terms "upper" and "lower" contemplate horizontal members and are not limiting insofar as elevation is concerned. Transfer shaft 208 integrally supports a transfer plate 212 and an intermittent cam 214 at its lower end thereof. Similarly, transfer shaft 210 integrally supports a transfer plate 216 and an intermittent cam 218 at its upper extremity thereof.

In a preferred embodiment of the present invention, transfer shafts 208 and 210, transfer plates 212 and 216, and intermittent cams 214 and 218 are substantially identical in shape and structural configuration with one another, thereby affording standardization and interchangeability of component parts of system 100. For this reason, the reader's attention is directed as an illustrative example to transfer plate 212 which is substantially cylindrical in a disc-like shape, the plane of the disc being substantially perpendicular to the paper when viewing FIG. 5. Seals 220 along the outer edges of transfer plates 212 contact the inert concave spherical surfaces 184 of cavity 180, and transfer cavity 134. In this way, a substantially fluid-tight seal is maintained between transfer plate 212 and the cavity surfaces with which it comes into contact. The same is true for transfer plate 216 which is provided with the same type of seals 220.

Intermittent cam 214 is shown at the lower extremity of transfer shaft 208 and in cooperative engagement with main cam 188. Movement of main cam 188 in a continuous rotary motion will result in and cause an intermittent-type and predetermined movement of both intermittent cams 214 and 218, as will be described.

Figure 7:
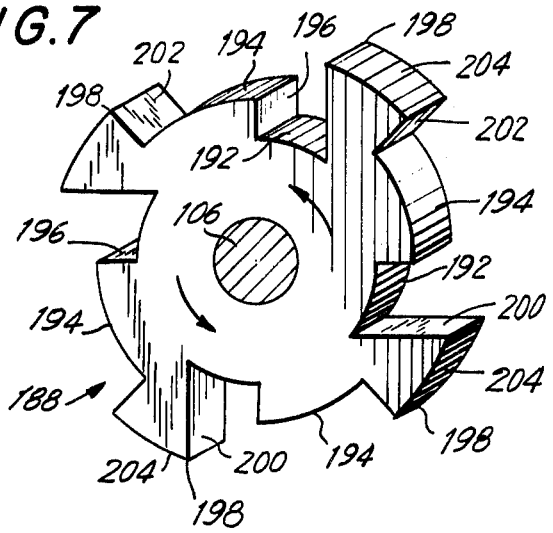
FIG. 7 is a perspective view of a main cam according to the present invention.
Figure 8:
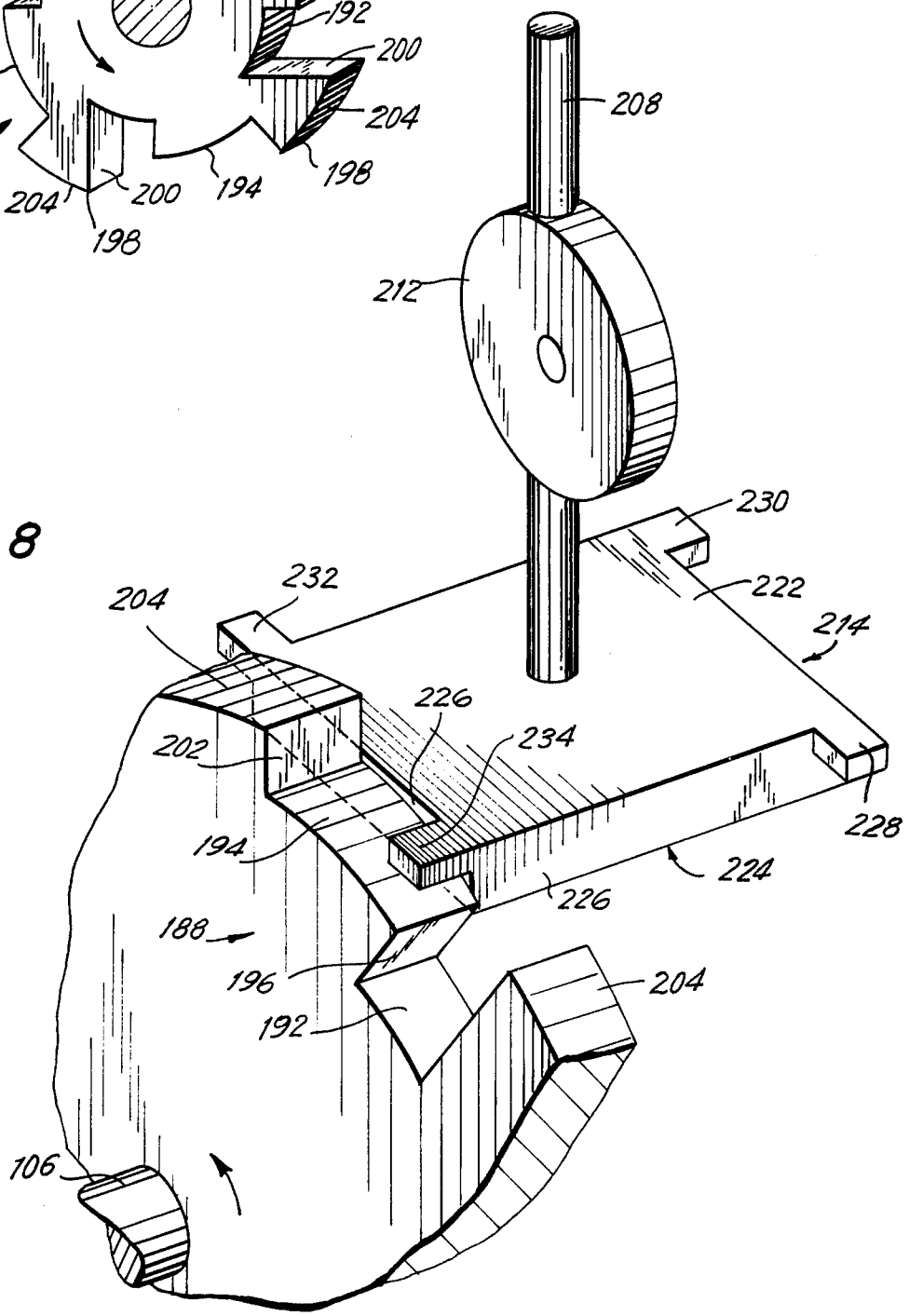
FIG. 8 is a partial perspective view of an intermittent cam and its associated shaft and transfer plate according to the present invention.

FIG. 7 best illustrates in a perspective-type view the shape of main cams 188 and 190, which is only partially reflected and illustrated within FIG. 6. FIG. 8 best illustrates the shape and configuration of intermittent cam 214, which is representative of both intermittent cams 214 and 218, as well as the two intermittent cams disposed on the opposite side of rotor member 160, and mirror duplicates of cams 214 and 218.

Intermittent cam 214 basically consists of a substantially flat or planar member having upper and lower surfaces 222 and 224, respectively. Sides 226 of intermittent cam 214 are interrupted by four outwardly extending fingers 228, 230, 232 and 234.

Main cams 188 and 190 are preferably housed within a chamber defined by spacer members 236 and cover plates 110 and 112. These spacer members 236 and the cover plates serve to maintain a tight chamber within which the interactions between main cams 188 and 190 and their respective intermittent cams occurs. This cooperative interaction will now be described.

As main cam 188 continuously turns, as best seen in FIGS. 7 and 8, the forward bearing surfaces 200 of finger portions 198 come into contact with and rotate respective fingers 228, 230, 232 and 234 of intermittent cam 214 about the axis of transfer shaft 208. Because of the spacing and configuration of these fingers 228, 230, 232 and 234, the continuous rotary movement of main cam 188 does not result in a continuous rotary movement of the intermittent cam 214. Instead, a locked intermittent movement is achieved as follows.

Once bearing surface 200 of main cam 188 rotates finger 232 to the position shown in FIG. 8, surfaces 206 of main cam 188 come into contact with and bear against the side 226 of intermittent cam 214 from which the next finger 234 extends. The sliding contacts between surfaces 206 and side 226 maintain intermittent cam 214 in the position shown in FIG. 8 as long as and until the bearing surface 200 of the next finger 204 comes into contact with finger 234 of the intermittent cam, whereby the sequence is repeated until another finger portion of main cam 188 comes into contact with finger 228. In the position shown in FIG. 8, intermittent cam 214 is unable to rotate out of this predetermined and selected position such that the orientation of transfer plate 212 in the cavity within which it is disposed, or for that matter outside the cavity, is certain. The present invention contemplates varying the shapes of main cam 188 and intermittent cam 214 such that the timing may be adjusted and varied within each step of this sequence.

What has just been described for intermittent cam 214 is likewise true for intermittent cam 218 and its associated transfer shaft 210 and transfer plate 216. Thus, the continuous rotation of main cam 188 influences both of intermittent cams 214 and 218 simultaneously, as best seen in FIG. 5. The same is true on the opposite side of rotor member 160.

It is hoped that the reader by now is gaining insight into the means by which transfer plates 212 and 216 move and cooperate with the surfaces of cavities 180 and 182, within which they are disposed. The sequence of events already described above for FIGS. 2*a* through 2*i* are realized with transfer plates 212 and 216.

In operation, rotor assembly 126 is started by means of starting gear 170 which is engaged by outside means with the result that rotor member 160 commences to rotate and accelerate. Shaft 106, which is integral with rotor member 160, rotates at the same angular speed. As shaft 106 continuously rotates, its associated main cams 188 and 190 likewise continuously rotate, with the result that intermittent cams 214 and 218 are caused to rotate in the intermittent manner just described for FIGS. 5, 7 and 8.

Combustible fluid in a charge is introduced as a result of negative pressure through inlet port 138 within transfer cavity 134. The charge of combustible fluid, once having entered through inlet port 138 in transfer cavity 134, flows into compression cavity 180 under the influence of this negative pressure differential caused by the expanding working volume and seal between transfer plate 212 and the walls or surfaces 184 of cavity 180. Once inside and filling cavity 180, this charge is compressed within cavity 180 by transfer plate 216, in the manner described above for FIGS. 2*d* and 2*e*. Likewise, the negative pressure and introduction of the charge into cavity or chamber 180 is synonomous to what has been described above for FIGS. 2*a*, 2*b* and 2*c*.

Figure 2I:
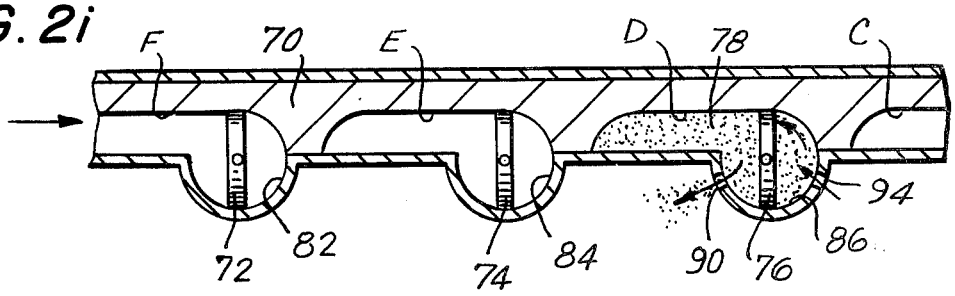

Transfer plate 216 further actually removes substantially all of the combustible charge from compression cavity 180 into transfer cavity 136, in the manner similar to what has been described above for FIG. 2*f*. Thereafter, spark plug 142 ignites the combustible charge now located within both transfer cavity 136 and a portion of combustion chamber or cavity 182, with the result that rotor member 160 is driven under the forces generated by the combustion process. During this driving of rotor member 160 under the force of the combustion process, a new charge of combustible fluid is being introduced through inlet port 138, as represented by FIG. 2*i* above in schematic form.

The present invention contemplates substantially the same mode of operation and cooperation on the opposite side of rotor member 160 such that a substantially vibrationless generation of power and energy is realized. The ignition on opposite sides of rotor member 160 may be accomplished either simultaneously or out of phase, at the choice of the party constructing the present invention. In one embodiment of this invention, the ignition occurs simultaneously, although other variations are contemplated, such as ignition taking place every 90° turn of the rotor. With both front and back transfer chambers horizontal and the rotor cavities at 90° to each other, such that firing would occur 4 times in a revolution in a much smoother manner than 2 times.

The result of this compression and combustion process described for system 100 is the generation of output power through shaft 106, which may be coupled by suitable mechanical means to motors, air compressors, or other devices requiring power. Because of the relatively small size of engine system 100, a number of applications can be realized where conventional cumbersome engines cannot be used.

A number of observations are wothwhile mentioning here in connection with system 100. Firstly, it should now be appreciated that the continuous rotary movement of main cams 188 and 190 is actually converted into intermittent rotary movement of intermittent cams 214 and 218 about axes substantially perpendicular with respect to the axis of output shaft 106. It must also be noted that the rotation or "counterrotation" of transfer plates 212 and 216 occurs in directions opposite with respect to the rotational direction of the surfaces of rotor member with which these transfer plates come into contact. Another point concerns the relative radii of the main cams 188 and 190 and their influenced intermittent cams 214 and 218. In the preferred embodiment of the present invention, the effective radius of each main cam is substantially twice that of the effective radius of each intermittent cam influenced thereby. Still another novel feature concerns the actual transfer of a compressed combustible fluid charge from the cavity within which it is pressed to an entirely different cavity. These overall features may exist in an engine system wherein, instead of four transfer plates as has been described in the preferred embodiment disclosed herein, multiples thereof and pluralities of transfer plates may be incorporated into the same system.

It must be pointed out here that the present invention further contemplates use of the structure described herein as a compressor. In addition, this invention contemplates the use of dowel-type members or pins in cooperation with cams in order to effect the controlled rotation described in detail above. More specifically, the use of intermittent cam-type assemblies corresponding to component members 50, 52 and 54 are contemplated without departing from the scope of this invention.

The embodiments of the present invention particularly disclosed and described are presented merely as examples of the invention. Other embodiments, forms and modifications of this invention coming within the proper scope and spirit of the appended claims will, of course, readily suggest themselves to those skilled in the art.

What is claimed is:

1. An internal combustion engine, comprising, in combination, a housing; a rotatable rotor assembly disposed within the housing and having cavities therein for receiving combustible fluid, output shaft means integral with said rotor assembly for conveying forces generated by combustion of said fluid, first cam means carried by and integral with said output shaft means, second cam means cooperative with and responsive to said first cam means, a shaft member integral with said second cam means and extending at an angle with respect to said output shaft means, a transfer member carried by said shaft member and having portions thereof movable into and out of said combustion cavities, said transfer member including surfaces which operably define a variable working volume of said combustion cavities, said transfer member serving to transfer a combustible charge of said combustible fluid from one cavity to another, said rotor assembly including a rotatable rotor member carried by and integral with said output shaft means, said rotor member being formed with at least two arcuately extending cavities within which said combustible fluid is compressed and combusted, said rotor member comprising at least one compression cavity and at least one combustion cavity within each opposing face thereof, said cavities extending along a common radius and being defined by curved surfaces within said rotor member, whereby during operation and rotary movement of said rotor there is caused first a transfer of a charge into said compression cavity, thereafter compression of the charge as between the rotor member walls defining said compression cavity and said transfer member surfaces, thereafter ignition of the charge, and thereafter expansion of the charge, thereby furthering said rotary movement, said internal combustion engine further comprising at least two transfer housings within which a transfer member is movable, each of said transfer housings having substantially curved surfaces which define a transfer cavity therein, surfaces of said transfer member being rotatable in contact with the respective curved surfaces of said transfer housing defining said transfer cavity and exhibiting a substantially fluid-tight seal therebetween, said transfer housings being disposed at each opposing side of said rotor assembly, said rotor assembly including a rotatable rotor member having surfaces which define compression and combustion cavities cooperatively located with respect to transfer cavities within each transfer housing, said first and second cam means intermittently rotating said transfer member with portions thereof within a transfer cavity and a cavity within said rotor member, the direction of rotation of said transfer member opposing the direction of rotation of said rotor member.

2. An internal combustion engine, according to claim 1, wherein the centers of the compression and combustion cavities of opposing sides of said rotor member are disposed at substantially 90° from one another, respectively.

3. An internal combustion engine, according to claim 1, wherein within each side of said rotor member a compression cavity receives a charge of combustible fluid which is compressed by a transfer member therewithin, a transfer cavity receiving said compressed charge and, together with a combustion cavity within said rotor member, containing the combustion of said charge.

4. An internal combustion engine, according to claim 1, wherein said first cam means comprises a substantially continuously rotatable cam member formed with a plurality of substantially radially extending finger portions thereof having bearing surfaces.

5. An internal combustion engine, according to claim 4, wherein said second cam means comprises at least one cam member having a plurality of outwardly extending fingers at least one of which is disposed in the path of the bearing surfaces of the finger portions of said first cam member, said fingers being engageable by said bearing surfaces at predetermined intervals which result in an intermittent rotational movement of said second cam member about an axis substantially perpendicular with respect to the axis of rotation of said first cam member.

6. An internal combustion engine, according to claim 5, wherein said first and second cam members include locking surfaces which engage one another and prevent rotation of said second cam member at times intermediate the engagement of said fingers by said finger portions and resulting movement of said second cam member.

7. An internal combustion engine, according to claim 6, wherein a pair of second cam members are cooperatively engaged and driven by said first cam member at one side of said rotor assembly, said engine including another first cam member, and a pair of second cam members driven thereby at an opposite side of said rotor assembly.

* * * * *